US006336300B1

(12) United States Patent
Babucke

(10) Patent No.: US 6,336,300 B1
(45) Date of Patent: Jan. 8, 2002

(54) DEVICE TO DIVERT WATER FROM DECK

(76) Inventor: Fred M. Babucke, 3379 Rte. 46 #16-J, Parsippany, NJ (US) 07054

( * ) Notice: Subject to any disclaimer, the term of this patent is extended or adjusted under 35 U.S.C. 154(b) by 0 days.

(21) Appl. No.: 09/450,663

(22) Filed: Nov. 30, 1999

Related U.S. Application Data

(60) Provisional application No. 60/115,704, filed on Jan. 12, 1999.

(51) Int. Cl.[7] ..... E04B 1/68; E04F 15/14

(52) U.S. Cl. ..... 52/396.04; 277/637; 277/647; 277/906; 277/921; 52/302.1; 52/11

(58) Field of Search ..... 52/11, 177, 302.1, 52/393, 396.04, 650.3; 277/630, 637, 641, 642, 647, 648, 650, 906, 921

(56) References Cited

U.S. PATENT DOCUMENTS

| | | | | | |
|---|---|---|---|---|---|
| D134,792 | S | | 1/1943 | Beil | |
| D182,784 | S | | 5/1958 | Bancroft | |
| 3,099,110 | A | | 7/1963 | Spaight | |
| 3,137,973 | A | | 6/1964 | Williams | |
| 3,604,169 | A | * | 9/1971 | Smith | 52/396.04 |
| D236,715 | S | | 9/1975 | Patterson | |
| D236,716 | S | | 9/1975 | Patterson | |
| D236,718 | S | * | 9/1975 | Patterson | 52/396.04 X |
| D260,557 | S | | 9/1981 | Bowman | |
| 4,360,992 | A | * | 11/1982 | Marino | 52/396.04 X |
| 4,522,413 | A | * | 6/1985 | Nicholas | 277/921 X |
| 4,717,162 | A | * | 1/1988 | Trieste et al. | 277/921 X |
| 4,810,548 | A | * | 3/1989 | Ligon, Sr. et al. | |
| 4,860,502 | A | * | 8/1989 | Mickelsen | 52/11 |
| 5,168,683 | A | * | 12/1992 | Sansom et al. | 52/396.04 |
| 5,195,281 | A | | 3/1993 | Kosko | |
| 5,511,351 | A | | 4/1996 | Moore | |
| 5,765,328 | A | | 6/1998 | Moore | |

FOREIGN PATENT DOCUMENTS

| | | |
|---|---|---|
| DE | 4315903 | 11/1994 |
| EP | 522992 | 1/1993 |
| JP | 5-25852 | 2/1993 |
| JP | 5-44310 | 2/1993 |

* cited by examiner

*Primary Examiner*—Carl D. Friedman
*Assistant Examiner*—Patrick J. Chavez
(74) *Attorney, Agent, or Firm*—Richard C. Litman

(57) ABSTRACT

Various embodiments of a sealing device serve to preclude the passage of water and debris between the conventional gaps in a deck. The water sealing device comprises an elongated member preferably formed of natural rubber with weather and ultraviolet resisting additives, but may be formed alternatively of vinyl or other resilient plastic materials as desired. In each embodiment, the seal has a pair of upwardly extending flanges along the top of each opposed edge. The sealing device fits tightly within the gap between the boards of a deck, preventing the passage of water and/or other debris between the boards. The flanges are biased outwardly, creating a watertight seal between the boards and the sealing device. Further sealing may be provided by the use of an adhesive and/or caulking compound at the time of installation of the seals, as desired.

19 Claims, 5 Drawing Sheets

DEVICE TO DIVERT WATER FROM DECK

REFERENCE TO RELATED PATENT APPLICATION

This application claims the benefit of U.S. Provisional Patent Application Ser. No. 60/115,704 filed on Jan. 12, 1999.

BACKGROUND OF THE INVENTION

1. Field of the Invention

The present invention relates generally to sealing means, and more specifically to various embodiments of flexible or pliable elastomer seals for fitting in the gaps between deck boards in an outdoor deck. The present seals serve to channel any water which falls upon the deck to the sides of the deck, rather than allowing the water to pass between the deck boards.

2. Description of Related Art

Exterior decks are conventionally constructed with relatively large gaps between the deck boards, to allow for expansion of the deck boards due to temperature and humidity changes and other factors. As a result, water, leaves, and other debris are free to fall and run off between the boards, thus soaking and cluttering the space below the deck. This precludes the use of what otherwise would be a convenient area for the storage of various articles, such as outdoor furniture, yard maintenance equipment, etc., with the area below the deck generally being wasted space.

Accordingly, a need will be seen for a device for diverting water from a deck, comprising a series of elongate seals for fitting between adjacent deck boards and serving to seal the gap between the boards to preclude the entrance of moisture, leaves, etc. into the area beneath the deck. Others have recognized this need and have attempted to provide various sealing means for decks and other areas in the past. However, none of the devices of the prior art provide the structure and/or function of the device of the present invention in its various embodiments, as indicated in the discussion of the related art below.

U.S. Pat. No. 3,099,110 issued on Jul. 30, 1963 to Harold L. Spaight, titled "Control Joint," describes an expansion joint for use in a wall constructed of cement blocks. The control joint is made from rubber, with a hard rubber central section and soft rubber ends. The soft rubber ends are configured to be compressed when the control joint is placed between blocks, forming a seal. The adjacent concrete blocks with which the Spaight joint is used, must be specially formed with facing grooves in order to fit the cruciform center section of the Spaight joint configuration. This configuration holds the Spaight joint in place between the concrete blocks. In contrast, the present seals are configured to fit tightly between conventional deck boards, with no special forming or shaping of the area between the boards being required for installation of the present seals. Moreover, the use of two different rubber compounds for the Spaight seal results in a relatively costly seal to produce, unlike the present seal.

U.S. Pat. No. 3,137,973 issued on Jun. 23, 1964 to Lloyd H. Williams, titled "Sealed-Joint Construction For Masonry Block Walls," describes a flexible joint seal having a generally T-shaped configuration when viewed from one end. The seal is generally formed of a relatively hard rubber, but includes a softer rubber flange extending across the distal end of the stem of the T. The crossmember of the T is placed within the open space within the blocks while the opposite end of the stem is placed between facing block surfaces, with the soft rubber providing a seal therebetween. The Williams seal, as in the Spaight seal discussed immediately above, includes two different hardnesses of material, thus resulting in a relatively costly seal device.

U.S. Pat. No. 4,751,125 issued on Jun. 14, 1988 to Helmuth Ofterdinger, titled "Composite Panel Having A Drip Groove," describes a panel having a core material with a waterproof cover sheet laminated over the outer surface thereof. Such panels are commonly used for kitchen counters and the like, and liquid runoff is known to spill and flow around the lip of such panels to remain along the underside and possibly delaminate any joint in that area. Ofterdinger provides a groove recessed into the underside of the panel with the sealed edges of the laminate being located therein, which causes any moisture runoff to accumulate along the protected edge rather than within the seal and joint. Accordingly, Ofterdinger does not provide any means for sealing the space between deck boards in an existing exterior deck, as provided by the present invention.

U.S. Pat. No. 4,810,548 issued on Mar. 7, 1989 to James T. Ligon, Sr. et al., titled "Sandwich Seal Structure," describes an expandable foam seal used for sealing gaps between automobile panels. The seal is placed inside the gap, and the parts are dipped into a coating material. The coating material enters the gap. When the panels are heated to cure the coating material, the foam expands, filling the gap. The technique is unsuitable for use in sealing the open gaps between deck boards, as the expansion of the material would extend above and below the open gaps, thus creating a raised area between boards rather than a runoff channel as provided by the configuration of the present seals.

U.S. Pat. No. 5,195,281 issued on Mar. 23, 1993 to John J. Kosko, titled "Deck Trough," describes a trough fitting between the floor joists of a deck, for channeling water away from the area under the deck. The trough has lips along each edge for covering the top of the joists on either side. The Kosko device allows water to pass through the deck and then channels it to the side of the deck, unlike the present invention, which channels water to the side of the deck before allowing it to pass through the deck. Moreover, the Kosko trough system must be installed during the construction of the deck, before the deck boards are installed over the joists, whereas the present sealing system may be installed in any existing completed deck, regardless of its age or time since completion.

U.S. Pat. Nos. 5,511,351 and 5,765,328 respectively issued on Apr. 30, 1996 and Jun. 16, 1998 to Grant M. Moore, both titled "Drainage System For Decks," describe systems in which a plurality of U-shaped channels are secured to the joists beneath the deck boards of a deck. While the Moore systems may be installed after the deck is completed by sealing their attachment edges to the joists, the system suffers from the same problem as the Kosko trough system described immediately above, in that water, leaves, and other debris are free to fall between the joists and become trapped in the troughs or channels immediately beneath the deck boards. In contrast, the present system seals the gaps between the boards, precluding the passage of water, leaves, etc. therethrough. All materials remain upon the upper surface of the deck boards, or run off in the channel defined by the slight depression of the seals between adjacent deck boards, rather than falling to the undersides of the deck boards, as in the Kosko and Moore systems.

U.S. Pat. No. Des. 134,792 issued on Jan. 12, 1943 to Forrest F. Beil, titled "Weather Strip," illustrates a generally rectangular shape with rounded edges. The rounded edges would allow water to collect in the resulting gap between the edges and the adjacent deck boards, thus leading to deterioration of the deck boards in that area. In contrast, the present seals in their various embodiments provide flanges for sealing securely against the adjacent deck boards, and provide a lower central groove so that water will collect only in the seal groove, rather than adjacent to any of the wood or other deck board material.

U.S. Pat. No. Des. 182,784 issued on May 20, 1958 to Joseph C. Bancroft, titled "Weatherstripping Unit," illustrates another design for a weatherstrip. The Bancroft weatherstrip is relatively wide for its height, and thus if it were made to fit the relatively narrow gap between conventionally spaced deck boards, it would not reach to the bottom surface of the boards to lock in place. Moreover, the flat upper flanges do not conform to the generally rounded corners of the boards, and would leave a crevice between the straight extensions and the curved corners of the boards. This would trap water and other debris, thus leading to deterioration of the deck boards. Also, the sides of the Bancroft seal are not parallel, but would define a gap between those sides and other adjacent flat structure. The present sealing devices provide a tight seal along their edges and sides, thus channeling all water and debris into the channel formed along the center of the seal.

U.S. Pat. Nos. Des. 236,715 and 236,716, both issued on Sep. 9, 1975 to William J. Patterson and titled "Prefoamed Expansion Joint," illustrate two different designs for such joints. Both designs have a flat upper surface, devoid of any channel formed therealong for capturing runoff and debris and channeling it to the edge of the deck. If the Patterson expansion joints were installed flush with the top surface of the deck, water and debris would remain upon the surface, thus leading to deterioration of the deck boards. In contrast, the present sealing devices each provide a central upper channel therealong to capture runoff and debris and guide it to the edge of the deck.

U.S. Pat. No. Des. 260,557 issued on Sep. 1, 1981 to William E. Bowman, titled "Expansion Joint Sealing Strip Assembly For Roadways Joints," illustrates a joint assembly formed of two generally rectangular side members with a generally V-shaped channel captured therebetween. The multiple component assembly of the Bowman design would result in a considerably more costly device than the current invention. Moreover, the two side members would compress together upon insertion of the Bowman strip between closely spaced deck boards, as the relatively thin V material folded together. The result would be an essentially continuous surface across the deck boards, or at most a very narrow crevice between the two side components, with such a narrow crevice serving to capture debris therein rather than allowing it to run off, as provided by the present invention.

European Patent Publication No. 522,992 published on Jan. 13, 1993 to Robertson Espanola S. A., titled "Watertight Roof For Buildings And Constructions In General," describes elongate roofing panels which provide drainage channels between each panel when assembled together. The assembly of the European Patent Publication differs from the present invention in that (1) the roof panels are formed of multiple components, unlike the unitary, monolithic construction of the present seals; (2) the roof panels form the actual covering surface, whereas the present seals are for installation between existing deck boards; and (3) the drainage channels of the panels are concealed, and thus may entrap debris therein and are more difficult to clean than the present seals.

Japanese Patent Publication No. 5-25,852 published on Feb. 2, 1993 illustrates a drainage system for a balcony. A collection pan is installed beneath the balcony floor, and serves to capture runoff from the side panels extending below the balcony hand rails. No means is apparent for sealing the gaps between individual floor or deck members, as provided by the present invention.

Japanese Patent Publication No. 5-44,310 published on Feb. 23, 1993 illustrates another drainage structure for a balcony. The balcony has a closed box structure for the floor, with runoff passing around the edge of the floor structure adjacent to the wall. As in the '852 Japanese Patent Publication discussed immediately above, the floor appears to be a sealed structure. Thus, no additional sealing means is required, as provided by the present invention for installation between spaced apart deck boards.

Finally, German Patent Publication No. 4,315,903 published on Nov. 17, 1994 illustrates two embodiments for sealing roof sheathing boards. In the first embodiment, the tongue of a tongue and groove board assembly is narrowed at its base to form a runoff collection channel. In the second embodiment, a separate plate is installed in a specially formed slot beneath the joined boards. In each case, the resulting runoff or condensate collection channels are concealed and subject to blockage by entrapped debris, unlike the open channels of the present sealing devices.

None of the above inventions and patents, either singly or in combination, is seen to describe the instant invention as claimed.

SUMMARY OF THE INVENTION

The present invention comprises various embodiments of an elongated water sealing member for installing within the conventional gap or space between the boards of a deck. The water sealing member is preferably made of a natural rubber material including additives for weather and ultraviolet resistance. However, other resilient materials, such as vinyl and/or other plastic, may be used as desired. The sealing member includes a flange extending upward from the top of each of the opposed sides. These flanges are biased towards the deck's boards, forming a watertight seal. Adhesive or caulking may, be provided between the flanges and the boards to further enhance the invention's watertight properties. The flanges define a channel between them, for directing water along its length, i.e. towards the sides of the deck when the sealing member is installed between the decking boards.

The deck board seals of the present invention may be installed to lie parallel with the plane of the boards for their entire length, or may be installed so the channel is inclined, angling downwardly from the top of the boards at their ends closest to the building toward the bottom of the boards at their ends farthest from the building. By inclining the seals downwardly away from the building, water will be directed away from the building to the opposite side of the deck.

The present deck board seals may be used either with natural or synthetic boards, and with boards of either type having either rounded or squared edges. If a board having rounded edges is used, the invention may have a bottom with a width greater than the rest of the invention. This bottom forms a downwardly pointing arrowhead, or a bulb, when viewed from one end of the invention. This wide bottom section, in conjunction with the top flanges, serves to secure the invention between the boards. The top flanges prevent downward movement, and the wide bottom prevents upward movement between the boards.

The width of the invention is slightly wider than the width of the gaps between the boards of a deck. The resilient properties of the invention, combined with the width specified, will result in a secure friction fit of the invention between the boards of a deck. Additionally, as the boards of a natural wood deck contract with age, the resilient material will expand towards its original width, thereby maintaining a proper seal between the boards. Additional sealing may be provided by means of adhesive and/or other caulking at the time of installation of the seals.

Accordingly, it is a principal object of the invention to provide a sealing device for preventing water from passing between the boards of a deck.

It is another object of the invention to provide a sealing device for a deck which directs water away from the building attached to the deck.

It is a further object of the invention to provide a sealing device for decks, with the device having a pair of top flanges along its side edges for enhancing the watertight properties of the seal, and for preventing downward movement of the seal.

Still another object of the invention is to provide a sealing device for decks, with the device having a wide bottom for preventing upward movement of the sealing device.

Yet another object of the invention is to provide a sealing device for decks, with the device preferably being formed of natural rubber material with additives for weather and ultraviolet protection, or alternatively of other resilient material, such as vinyl or other plastic material as desired.

An additional object of the invention is to provide a sealing device for decks, with the device including adhesive and/or other caulking means for providing a better seal.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The present invention comprises a sealing device for sealing the gaps conventionally placed between adjacent deck boards in exterior deck surfaces. The present seals, in their various embodiments, serve to preclude the passage of moisture, leaves, and other debris through the gaps, thereby providing a dry area beneath the deck for the storage of yard implements, tools, etc. as desired.

The present seal is an elongated member, preferably formed of a single mass of homogeneous natural rubber material for its resilience and elastomeric properties. Such natural rubber is preferably treated or mixed with additional compounds to provide resistance to weather and ultraviolet radiation (sunlight), as is conventionally known with such materials. Alternatively, other materials may be used, such as latex, resilient vinyl, and silicone sealant. The critical characteristic of the material chosen to make the invention is resilience, such that the purposes of the structures as described herein can be met. Preferably, the material should also be flexible to allow for deviations in positioning of the device between the decking boards. Finally, for economy of cost during manufacturing, the material should be chosen so that the elongated member can be integrally formed to have the structures as described.

Figure 1:
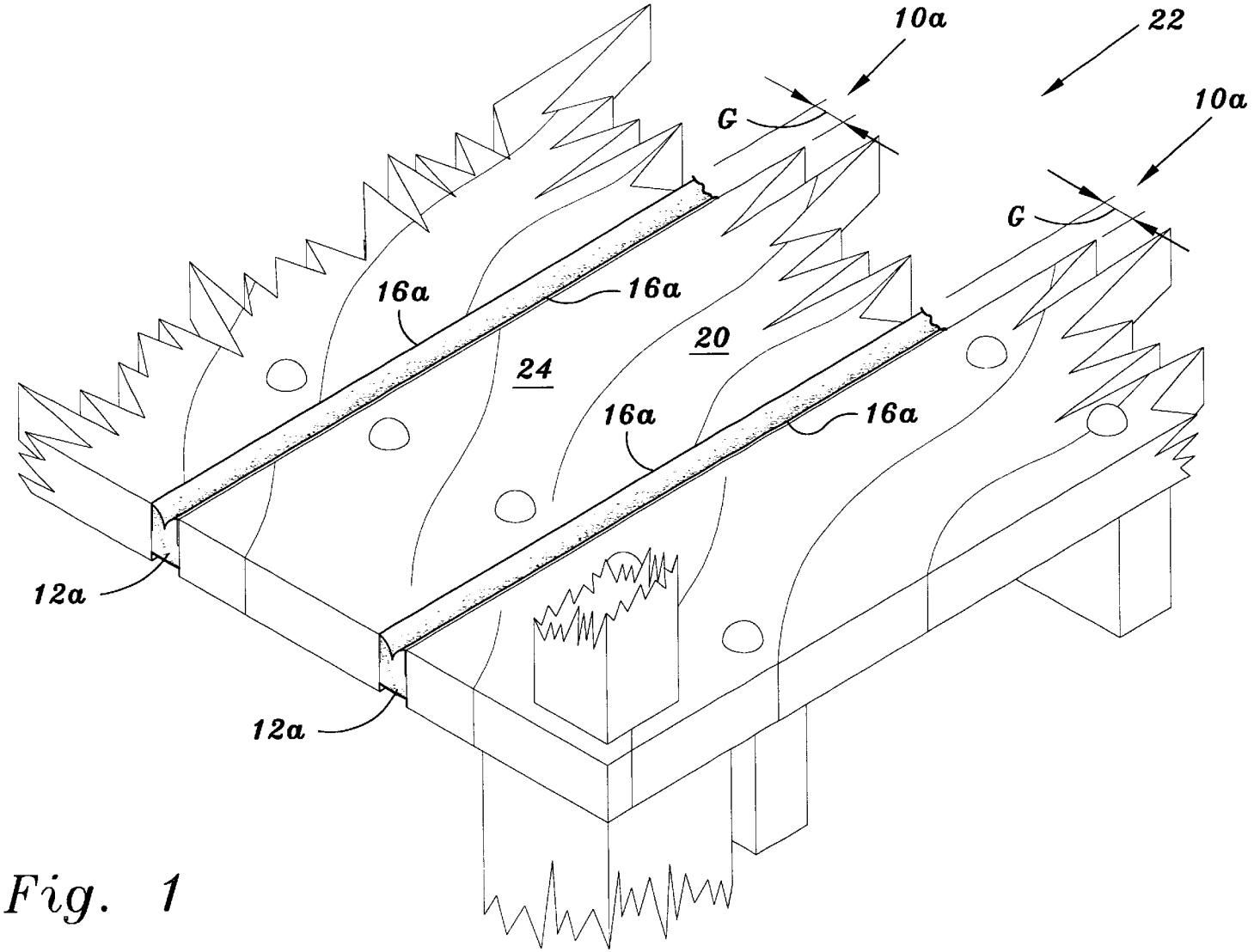
FIG. 1 is a broken away environmental perspective view of a first embodiment of a device to divert water from deck according to the present invention, showing a first state of insertion.
Figure 2:
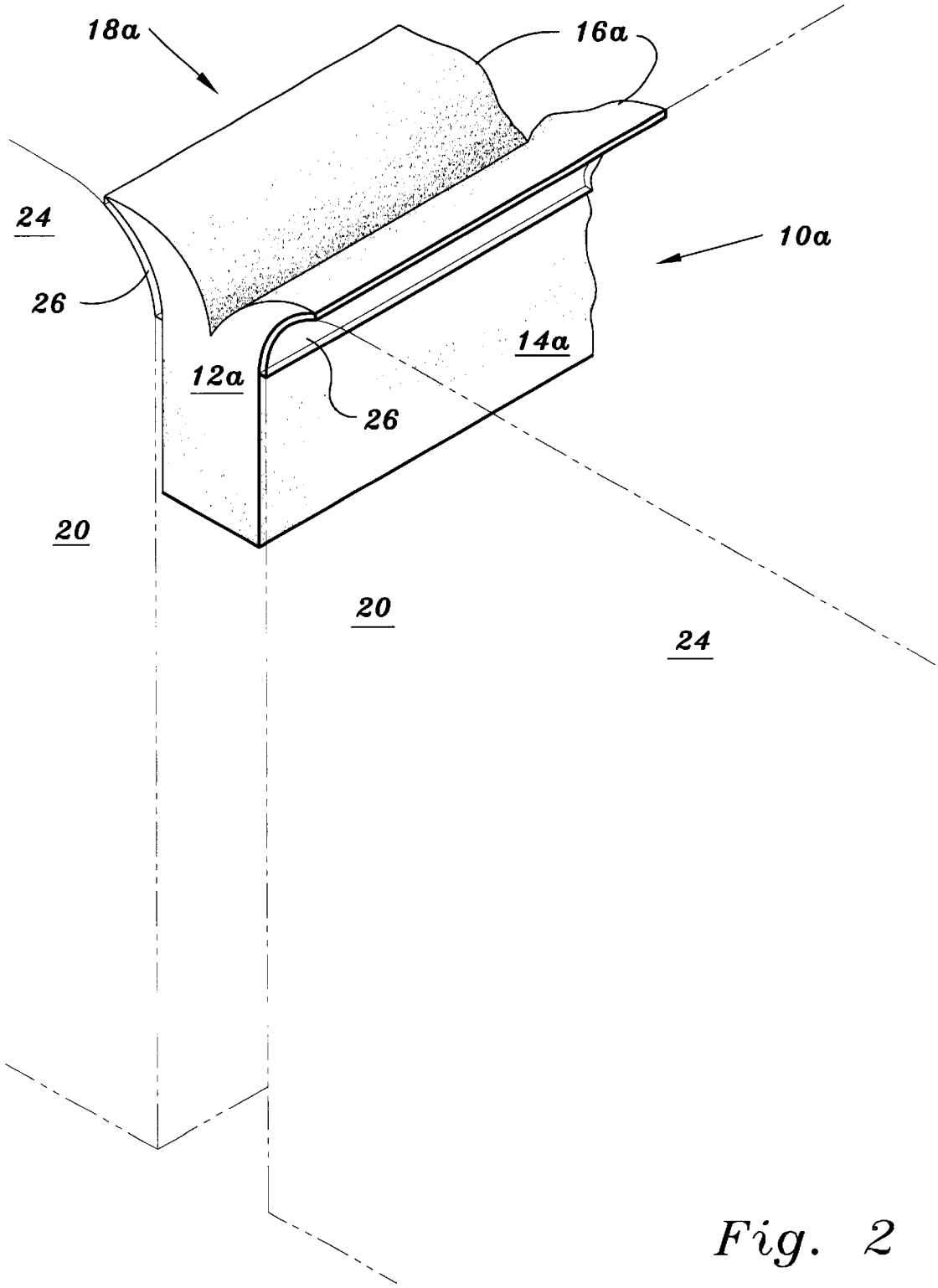
FIG. 2 is a perspective view of the embodiment of FIG. 1, showing a second state of insertion.

Referring to FIGS. 1 and 2, a first embodiment of the sealing device is shown, and designated as seal 10*a*. The first, second, third, and fourth embodiments of the sealing device will be referred to as 10*a*, 10*b*, 10*c*, and 10*d*, respectively shown in FIGS. 1 and 2 (seal 10*a*), 3, 4, and 5. The sealing device 10*a* includes a central body 12*a* having sides 14*a*. The natural or uncompressed distance or thickness between the sides 14*a* of the seal 10*a* (and the sides of other embodiments, as well) is slightly greater than the gap G between the boards 20 of deck 22, so that sealing devices 10*a* through 10*d* fit frictionally between the boards 20.

A pair of flanges 16*a* extend upwardly from the tops of sides 14*a*. The flanges 16*a* are biased outwardly, and define a water and debris runoff channel 18*a* therebetween. In FIGS. 1 and 2, the channel 18*a* is defined by the two opposed flanges 16*a* with their somewhat convex facing surfaces, thus defining a relatively sharp crease at the bottom of the channel 18*a*. However, it will be seen that while the channel may be configured somewhat differently in each of the embodiments, it serves the same general purpose in each embodiment, i. e., to collect runoff and debris from the deck boards 20 and drain such runoff to the open edge of the deck, rather than allowing it to pass through the gaps G between the boards 20.

In use, the sealing device 10*a* is installed tightly between the adjacent boards 20 of the deck 22, with flanges 16*a* biased outwardly against the top portion 24 of the boards 20. The outward biasing of flanges 16*a* against the boards 20 creates a watertight seal between sealing device 10*a* and boards 20. The watertight seal may be enhanced by the addition of further liquid proof sealant 26 between each of the flanges 16*a* (on the side of the flanges) and the contacting surface of the adjacent boards 20, as shown in detail in FIG. 2 of the drawings. Such additional sealants 26 (which may be caulking material, silicone sealant, or adhesive) may also ease the installation of the present sealing devices in an existing completed deck, as the semi-liquid state of such materials before setting may provide some lubricant qualities between the seal 10*a* (and seals 10*b* through 10*d*, in other Figures) and adjacent board 20 surfaces as the seals 10 are wedged between the adjacent boards.

Figure 3:
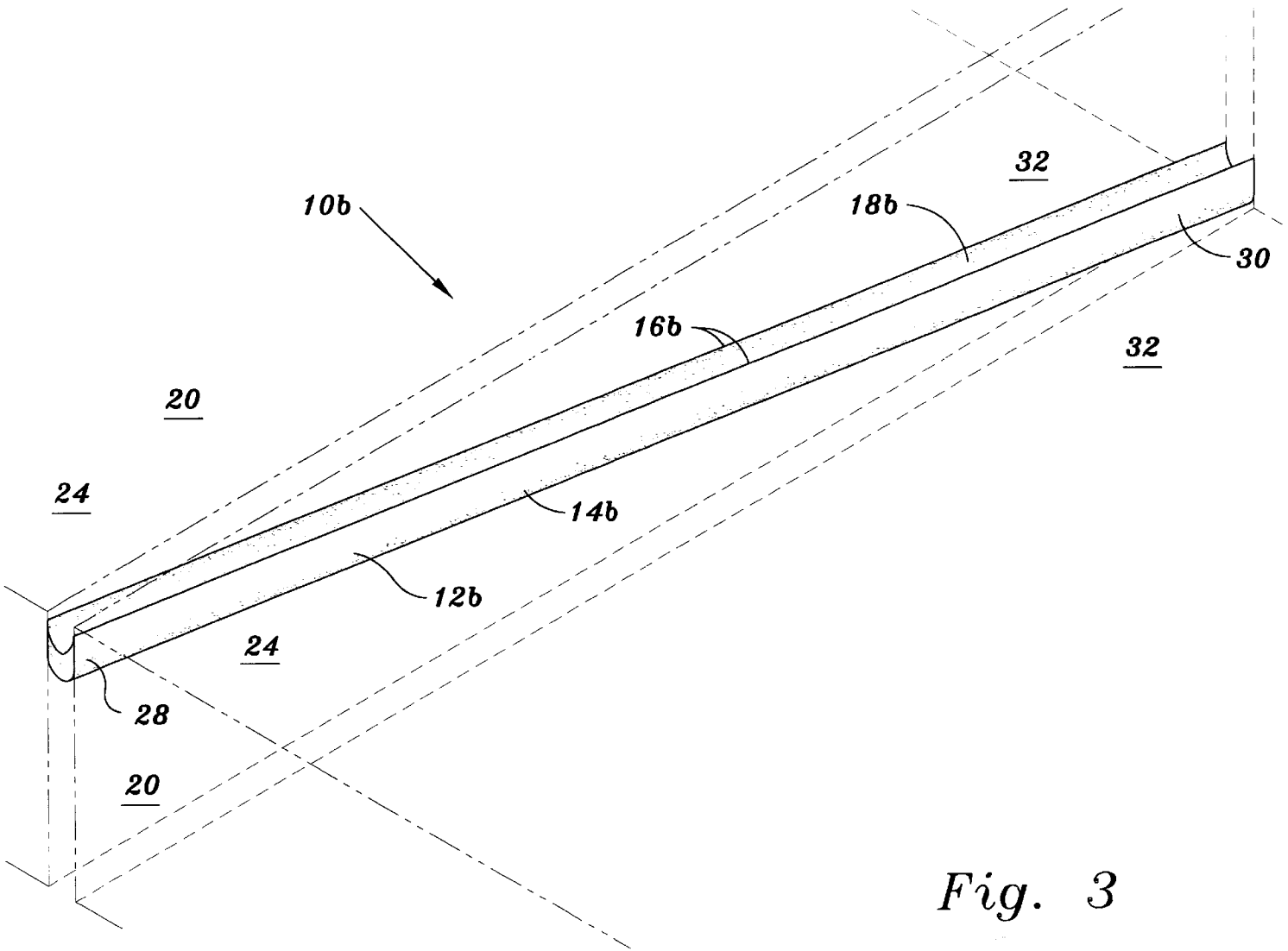
FIG. 3 is a perspective view of a second embodiment of the present invention, comprising a generally U-shaped channel installed with a downward slope between deck boards to promote drainage.

A second embodiment sealing device 10*b* is illustrated in FIG. 3. The sealing device 10*b* includes a central body 12*b* having sides 14*b*, analogous to the body 12*a* and sides 14*a* of the seal 10*a* of FIGS. 1 and 2. A pair of flanges 16*b* extend upwardly from the tops of sides 14*b*. The distance between the sides 14*b* is slightly greater than the gap between the boards 20 of deck 22, so that the sealing device 10*b* fits frictionally between the boards 20. A pair of flanges 16*b* extend upwardly from the tops of the sides 14*b*. The flanges 16*b* are biased outwardly, and define a channel 18*b* between them. It will be noted that the facing surfaces of the flanges 16*b* are concave, and define a generally U-shaped trough with a smoothly rounded contour therebetween, unlike the seal 10*a* embodiment of FIGS. 1 and 2. In some installations this may be preferred, as the smoothly rounded contour may reduce any tendency for leaves and other debris to catch within the trough.

In use, the sealing device 10*b* of FIG. 3 fits between boards 20 of deck 22, with flanges 16*b* biased towards the boards 20, generally in the manner of the seal 10 of FIGS. 1 and 2. However, it will be noted that the sealing device 10*b* is installed at a slope or angle between the adjacent deck boards 20. The first end 28 of the seal 10*b* is positioned immediately adjacent the top or upper surface 24 of the deck boards 20, with the opposite second end 30 of the elongate seal being positioned immediately adjacent the opposite bottom surface 32 of the deck boards 20, thereby defining a slope for the seal 10*b* relative to the deck boards 20.

The higher first end 28 is positioned adjacent any building structure from which the deck extends, with the opposite second end 30 being located at the open end of the deck opposite the attachment of the deck to the structure. Thus, the sealing device 10*b* slopes or angles downwardly away from the building structure and toward the open end or edge of the deck, to drain off any water or debris which runs off from the deck boards 20 into the channel 18*b* to the lower open end 30 of the seal 10*b*. It will be seen that the above described installation shown in FIG. 3 for the sealing device 10*b*, may be applied to any of the sealing devices 10*a* through 10*d* of the present invention, as well.

Figure 4:
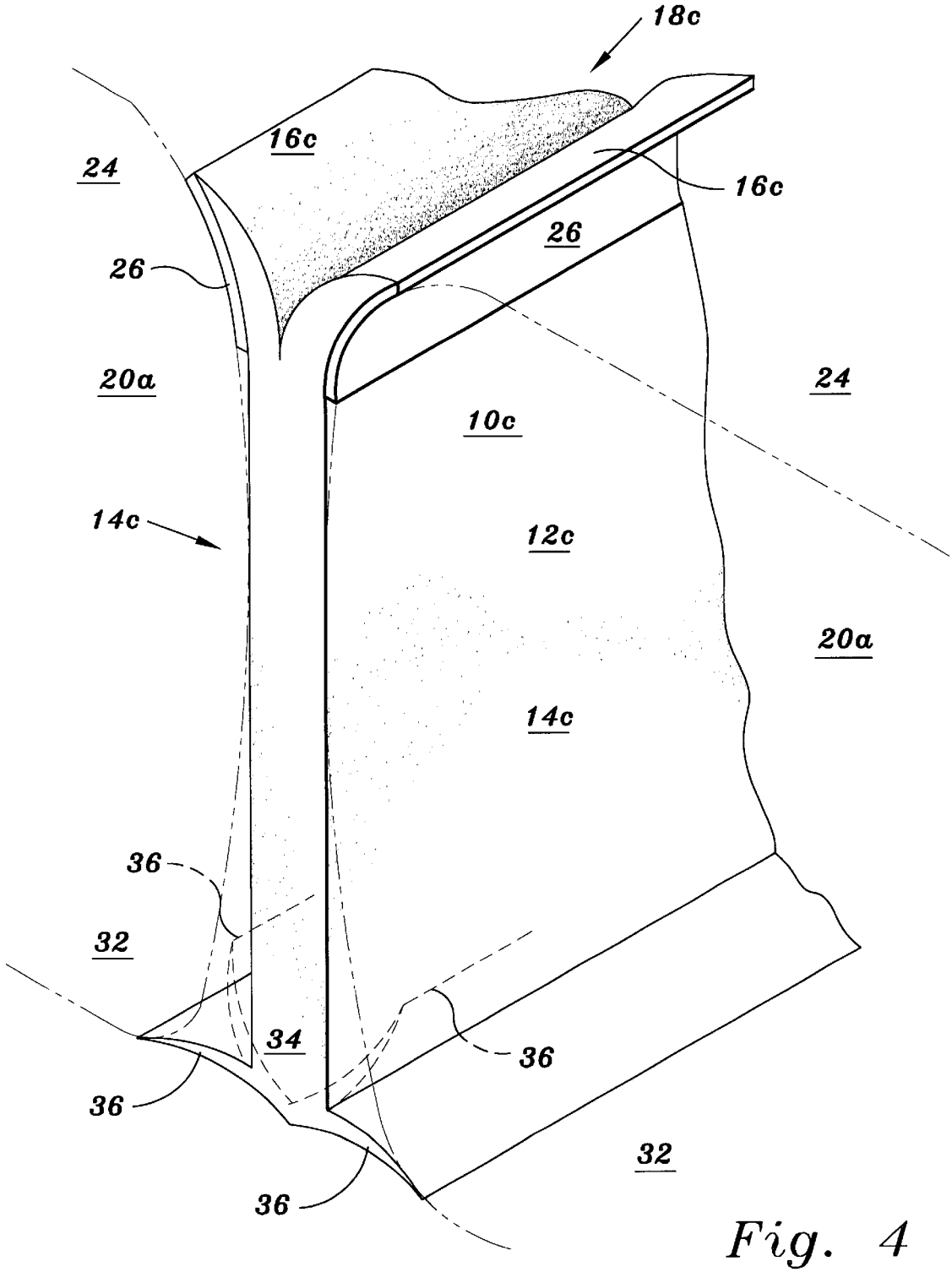
FIG. 4 is a perspective view of a third embodiment of the present invention, having a pair of locking flanges extending from the lower edges of the device.

A third embodiment comprising sealing device 10*c* is illustrated in FIG. 4 of the drawings. Sealing device 10*c* is intended for use between boards 20*a* having rounded edges. The sealing device 10*c* includes a central body 12*c* having sides 14*c*, analogous to components 12*a*, 12*b* and 14*a*, 14*b* of the devices 10*a*, 10*b* of FIGS. 1 through 3. The distance between the sides 14*c* is slightly greater than the gap between the boards 20*a* of the deck, in the manner described further above, so that the sealing device 10*c* fits frictionally between the boards 20*a*. A pair of flanges 16*c* extend upwardly from the tops of sides 14*c*. The flanges 16*b* are biased outwardly, and define a channel 18*c* between them in the manner described for the previously discussed embodiments and particularly for the seal 10*a* of FIGS. 1 and 2.

The bottom portion 34 of the sealing device 10*c* of FIG. 3 has a generally arrow shaped cross sectional configuration, when the seal 10*c* is in an undistended configuration as indicated by the broken line showing of the two edges or flanges 36 defining the arrow configuration in FIG. 3. When the seal 10*c* is pressed between the gap between the two boards 20*a*, the two flanges 36 extend beyond the bottom surface 32 of the boards 20*a* and spread to lock the seal 10*c* in place between the two adjacent boards 20*a*, as indicated by the solid line showing of the arrowhead flanges 36 in FIG. 3.

In use, sealing device 10*c* fits between the boards 20*a* of the deck, with flanges 16*c* biased outwardly against the top portion 24 of the boards 20. The outward biasing of the flanges 16*c* against the rounded corners or edges of the boards 20*a* creates a watertight seal between the sealing device 10*c* and the boards 20. The watertight seal may be enhanced by the addition of a caulk and/or adhesive 26 between the flanges 16*c* and boards 20*a*, in the manner described further above for other embodiments. Additionally, the flanges 16*c* prevent the downward movement of sealing device 10*c*. Thus, the outward distension of the bottom arrowhead flanges 36 against the bottom surface 32 of the boards 20*a*, along with the outward distension (and adhesive attachment, if used) of the upper flanges 16*c* against the rounded upper edges of the upper surfaces 24 of the boards 20*a*, serve to capture the seal 10*c* tightly and immovably between adjacent boards 20*a* to provide a permanent and waterproof seal.

Figure 5:
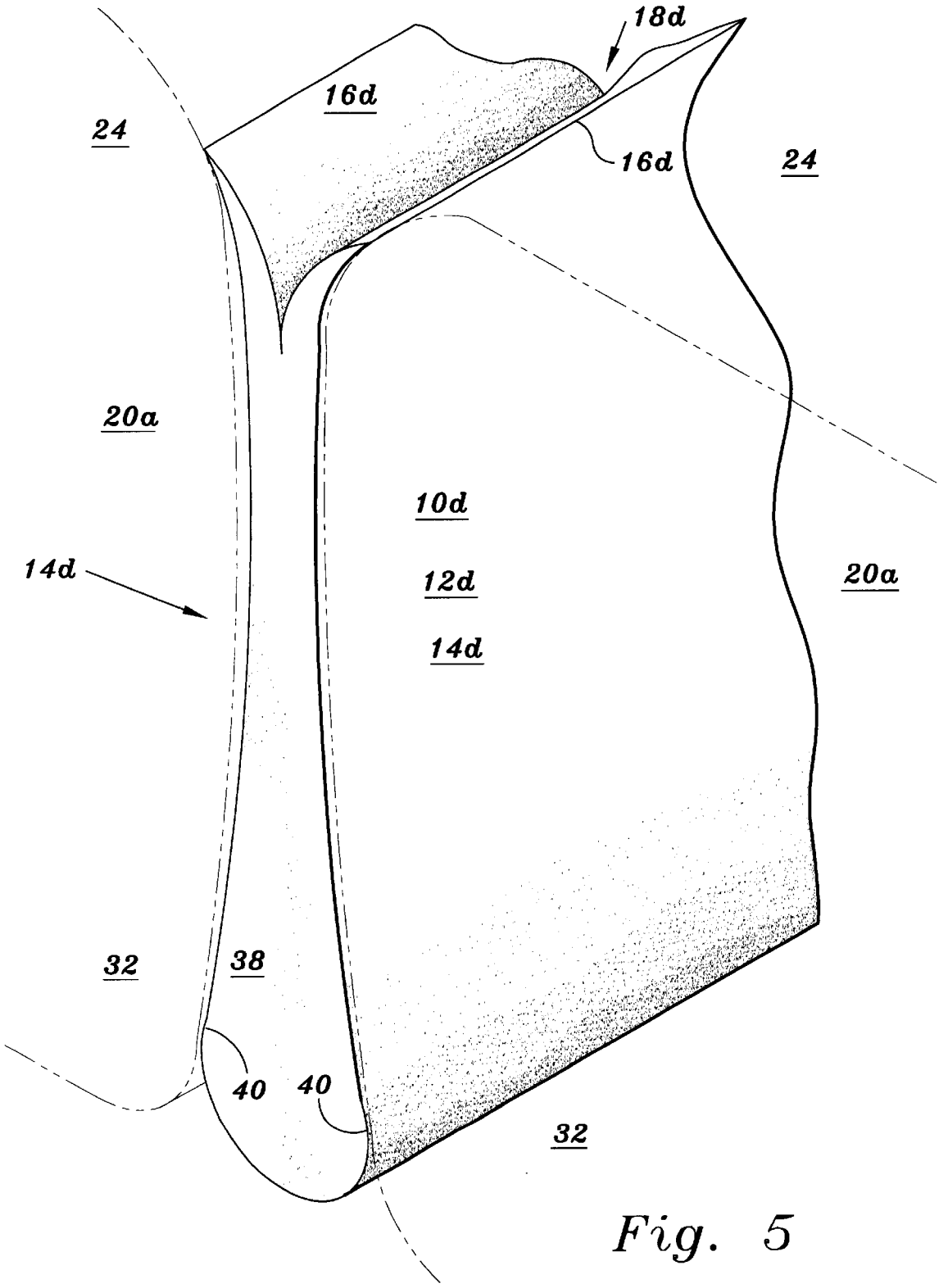
FIG. 5 is a perspective view of a fourth embodiment of the present invention, having a relatively wider bulb-shaped lower end for capturing the device between adjacent deck boards.

A fourth embodiment comprising a sealing device 10*d* is illustrated in FIG. 5. Sealing device 10*d* is intended for use between boards having rounded edges, in the manner of the seal 10*c* of FIG. 4. The sealing device 10*d* includes a central body 12*d* having sides 14*d*. The distance between the sides 14*d* is slightly greater than the gap between the boards 20*a* of the deck, so that the sealing device 10*d* fits frictionally between the boards 20. A pair of flanges 16*d* extend upwardly from the tops of sides 14*d*, and are biased outwardly therefrom. The flanges 16*d* define a sharply creased channel 18*d* between them, in the manner of the channels 18*a* and 18*c* of FIGS. 1, 2, and 4. The height or distance between the top ends of the flanges 16*d* and the bottom portion 38 of the seal 10*d* may be slightly less than the thickness of the boards 20*a*, in order to seat the seal 10*d* securely between the boards 10*a*.

The bottom portion 38 of the seal 10*d* has a generally bulb-shaped configuration with the outermost surface width 40 of the lowermost end being somewhat greater than the width or distance between the opposite first and second sides 14*d* of the seal 10*d*, so as to wedge the seal 10*d* tightly at the bottom of the gap or space between the two boards 20*a*. This serves to pull the upper end or top of the seal 10*d* securely downwardly between the upper edges of the adjacent boards 20*a*, thereby providing a moistureproof seal. Additional caulking or adhesive sealing means (not shown) may be used with the seal 10*d* of FIG. 5, in the manner of the other seals 10*a* through 10*c* discussed above.

In use, the sealing device 10*d* fits between boards 20 of deck 22, with the flanges 16*d* biased against the facing edges of the top portion 24 of the boards 20*a*. The outward biasing of flanges 16*d* against boards 20*a* creates a watertight seal between sealing device 10*d* and boards 20*a*. Additionally, the flanges 16*d* prevent the downward movement of sealing device 10*d*. The bulb surfaces 40 on the bottom of sealing device 10*d* are biased against the bottom portions 32 of the boards 20*a*, thereby preventing upward movement of the sealing device 10*d*. The sealing device 10*d* is thereby anchored solidly and immovably in place between adjacent boards 20*a*.

It should be understood that typically, deck construction standards determine the gap between decking boards to compensate for wood expansion coefficients, and the recommended construction gap width is 3/16 of an inch. In practice, such measurement is in turn often determined by the standard gauge of the decking nail being used. For example, a 20 penny decking nail may approximate 3/16 of an inch in shank diameter, and may be used as a gapping tool to speed the construction process in lieu of measuring. Therefore, the recommended predetermined minimum width between surfaces of sides 14 is approximately 3/16 inch, and, consequently, the width of the arrowhead or bulb portions should exceed such measurement in order to accomplish its intended purpose. Likewise, the standard decking boards typically used are nominal 1×6 inch lumber, suggesting a flange-to-bottom measurement of approximately 25/32 inch, corresponding to the actual lumber thickness dimension.

As noted above, all embodiments of the invention are slightly wider than the width of the gap between the boards of a deck. Consequently, installing the invention will involve compressing the seals slightly. The resilient material allows for such compression, which results in both the outward biasing of the top flanges against the boards, but also ensures that the invention expands back to its original width if the deck's boards shrink with age, maintaining a tight seal between the boards and the invention.

In summary, the present sealing devices provide a rapid, economical, and easily installed means of sealing the surface of an exterior deck for providing a dry and orderly area therebeneath for storage or other purposes as desired. It is noted that while the present disclosure describes use of the present seals with natural wood decking materials, the seals in each of their embodiments may be used equally as well with synthetic decking materials such as plastics, refined metals, etc., as desired. Also, while only a single embodiment has been described using a sloped installation to promote liquid runoff, it will be seen that any of the embodiments of the present invention may be installed in a similar manner in order to promote liquid runoff from any deck structure. The result is a much needed means of economically converting what previously had been wasted space beneath a deck, to usable space for storage of various articles or other purposes as desired.

It is to be understood that the present invention is not limited to the sole embodiments described above, but encompasses any and all embodiments within the scope of the following claims.

What is claimed is:

1. A water sealing device for sealingly installing within a gap between adjacent boards of a conventional exterior deck construction, comprising:

an elongated seal formed of a single unitary mass of homogeneous resilient material;

said seal having a top, a bottom portion, generally parallel opposed first and second sides defining a width therebetween, and opposed first and second ends defining a length between said ends;

said seal for providing a tight and leakproof fit between adjacent boards;

first and second flanges extending upwardly respectively from said first and second sides of said seal;

each of said flanges having an upper edge and being biased outwardly from said sides of said seal for sealing tightly against adjacent boards and defining a water and debris runoff channel therebetween; and including additional sealing means disposed on said sides of said seal.

2. The water sealing device according to claim 1, wherein said additional sealing means is selected from the group consisting of caulking material, silicone sealant, and adhesives.

3. The water sealing device according to claim 1 wherein said top defines a generally U-shaped channel having a smoothly rounded contour.

4. The water sealing device according to claim 1 wherein said top defines a generally V-shaped channel having a sharply creased center.

5. The water sealing device according to claim 1 wherein said bottom portion has a generally bulb-shaped configuration.

6. The water sealing device according to claim 1, wherein said bottom portion has a generally arrow shaped undistended cross sectional configuration.

7. The water sealing device according to claim 1, wherein said seal is formed of a single material selected from the group consisting of natural rubber with weather and ultraviolet resistant additives, latex, resilient vinyl, and silicone sealant.

8. An exterior deck and a water sealing device therefor, comprising in combination:

a deck comprising a plurality of spaced apart deck boards, with adjacent ones of said deck boards defining a gap therebetween and each of said deck boards having a thickness;

a water sealing device installed within said gap between said adjacent deck boards, comprising an elongated seal formed of a single unitary mass of homogeneous resilient material;

said seal having a top, a bottom portion, generally parallel opposed first and second sides defining a width therebetween, and opposed first and second ends defining a length between said ends;

said width of said seal being slightly greater than said gap between said adjacent deck boards, for providing a tight and leakproof fit between said adjacent deck boards;

first and second flanges extending upwardly respectively from said first and second sides of said seal; and each of said flanges having an upper edge and being biased outwardly from said sides of said seal for sealing tightly against said adjacent boards and defining a water and debris runoff channel therebetween.

9. The exterior deck and water sealing device combination according to claim 8, including additional sealing means disposed between said sides of said seal and said adjacent deck boards.

10. The exterior deck and water sealing device combination according to claim 9, wherein said additional sealing means is selected from the group consisting of caulking material, silicone sealant, and adhesives.

11. The exterior deck and water sealing device combination according to claim 8 wherein said top of said seal defines a generally U-shaped channel having a smoothly rounded contour.

12. The exterior deck and water sealing device combination according to claim 8 wherein said top of said seal defines a generally V-shaped channel having a sharply creased center.

13. The exterior deck and water sealing device combination according to claim 8, wherein:

said bottom portion of said seal has a generally bulb-shaped configuration with a lowermost end and a width greater than said width between said first and second sides of said seal, and;

said seal further has a height between said upper edges of said flanges and said lowermost end of said bottom portion, with said height of said seal being slightly less than said thickness of said deck boards.

14. The exterior deck and water sealing device combination according to claim 8, wherein said bottom portion of said seal has a generally arrow shaped undistended cross sectional configuration.

15. The exterior deck and water sealing device combination according to claim 8, wherein said seal is formed of a single material selected from the group consisting of natural rubber with weather and ultraviolet resistant additives, latex, resilient vinyl, and silicone sealant.

16. The exterior deck and water sealing device combination according to claim 8, wherein said seal is installed within said gap of said adjacent deck boards with said first end higher than said second end and defining a drainage slope therealong.

17. The exterior deck and water sealing device combination according to claim 8, wherein said deck boards are formed of natural wood.

18. The exterior deck and water sealing device combination according to claim 8, wherein said deck boards are formed of synthetic material.

19. A water sealing device for sealingly installing within a gap between adjacent boards of a conventional exterior deck construction, comprising:

an elongated seal formed of a single unitary mass of homogeneous resilient material;

said seal having a top having a generally U-shaped channel having a smoothly rounded contour, a bottom portion, generally parallel opposed first and second sides defining a width therebetween, and opposed first and second ends defining a length between said ends;

said seal for providing a tight and leakproof fit between adjacent boards;

first and second flanges extending upwardly respectively from said first and second sides of said seal; and each of said flanges having an upper edge and being biased outwardly from said sides of said seal for sealing tightly against adjacent boards and defining a water and debris runoff channel therebetween.

* * * * *